US006196196B1

(12) United States Patent
Gras et al.

(10) Patent No.: US 6,196,196 B1
(45) Date of Patent: Mar. 6, 2001

(54) INTERNAL COMBUSTION ENGINE CONTROL ACCORDING TO RUNNING TIME

(75) Inventors: Jürgen Gras, Bietigheim-Bissingen; Claus-Dieter Nusser, Schwieberdingen; Guido Ehlers, Wettstetten, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/269,774

(22) PCT Filed: Aug. 5, 1998

(86) PCT No.: PCT/DE98/02243

§ 371 Date: Apr. 1, 1999

§ 102(e) Date: Apr. 1, 1999

(87) PCT Pub. No.: WO99/07986

PCT Pub. Date: Feb. 18, 1999

(30) Foreign Application Priority Data

Aug. 5, 1997 (DE) ..... 197 33 763

(51) Int. Cl.[7] ..... F02D 41/04; F02D 41/24

(52) U.S. Cl. ..... 123/478; 123/480; 123/486; 701/102; 701/103; 701/115

(58) Field of Search ..... 123/478, 480, 123/481, 486; 701/101, 102, 103, 107, 113, 115

(56) References Cited

U.S. PATENT DOCUMENTS

| | | | | |
|---|---|---|---|---|
| 4,074,648 | * | 2/1978 | Reid et al. | 114/144 RE |
| 4,181,944 | | 1/1980 | Miyakawa et al. | 701/108 |
| 4,375,207 | | 3/1983 | Sieber et al. | 123/333 |
| 4,592,331 | * | 6/1986 | Pouring | 123/660 |
| 4,770,135 | | 9/1988 | Jautelat et al. | 123/179.17 |
| 5,617,836 | * | 4/1997 | Cullen et al. | 123/674 |
| 5,968,107 | * | 10/1999 | Vogan et al. | 701/102 |

FOREIGN PATENT DOCUMENTS 1615763 12/1990 (SU) .

OTHER PUBLICATIONS

Article from "Automotive Electric/Electronic Systems", VDI Verlag, 1988, pp. 262 to 303.

* cited by examiner

*Primary Examiner*—Henry C. Yuen
*Assistant Examiner*—Hieu T. Vo
(74) *Attorney, Agent, or Firm*—Walter Ottesen

(57) ABSTRACT

A method and an arrangement for controlling an internal combustion engine (1) are introduced and have actuators (3), which influence at least one control parameter relevant for the consumption of fuel of the engine. A control appearance forms an index L for the run-in state of the engine. The drive signals y of the actuators (3) are changed in dependence upon the above-mentioned index L in a predetermined manner.

10 Claims, 2 Drawing Sheets

INTERNAL COMBUSTION ENGINE CONTROL ACCORDING TO RUNNING TIME

FIELD OF THE INVENTION

The invention relates to the selection of operating parameters of an internal combustion engine control dependent upon the run time of the engine.

BACKGROUND OF THE INVENTION

An arrangement for limiting rpm of an internal combustion engine is known from DE 28 00 433 wherein the permissible highest rpm is controllable in dependence upon a roadway signal and/or a time signal. This permits limiting the highest rpm during the run-in phase to comparatively low values without limiting the rpm spectrum useable for the full power development in the run-in state. The mentioned limitation is targeted to a protection of the engine against increased wear which can go as far as a destruction. An adaptation of control parameters to the wear of an engine is known from U.S. Pat. No. 4,181,944 in accordance with which the wear is detected via the combustion chamber pressure or is estimated from the signal of a distance counter.

Conventional controls of internal combustion engines provide for a plurality of operating parameters in the region of the air/fuel mixture formation and the ignition which influence the power, the consumption and the exhaust gas emissions. An example of such an engine control is described in the publication "Automotive Electric/Electronic Systems", VDI Verlag, 1988, pages 262 to 303. In known systems, the determination of the operating parameters is orientated on the requirement of the engine which is not yet run in. That is, the sets of data are matched to the comparatively high friction power loss of a new engine.

SUMMARY OF THE INVENTION

The object of the invention is the further improvement of the known control of an internal combustion engine especially with a view to the fuel consumption and the toxic emissions.

The essence of the invention is to change the following data sets in dependence upon the run-in state of the engine: the driving performance, the exhaust-gas emission and especially the sets of data relevant to the consumption. Here, the run-in state can be advantageously modeled by data which are anyway present in the control of the engine or can be easily formed. Examples of such data are:

- the sum of the ignitions since the original start, that is, since the first start of the engine after the manufacture thereof;
- the sum of the operating times;
- the travel distance covered;
- the sum of the injection times;
- the integral of the through-putted air mass during the operating time;
- the integral of the throttle flap position; and,
- the integral of the vehicle speed, all of these quantities computed since the original start and/or the sum of the start operations of the engine which have taken place since the original start.

A consideration of the friction losses of the engine and therefore of the run time via evaluation of a start counter is especially advantageous because it is of little complexity.

Sets of data which are pertinent for continuous adaptation or stepped adaptation are the base values for the following:

- fuel injection quantities;
- factors for the transition compensation for acceleration operations, especially the
- mixture enrichment factors for the restart and warm-running mixture enrichment. Additional examples are
- data for the load-changing measures (which cause a jolt in the drive train) in mixture and ignition such as a reduction in torque by retarding the ignition. In addition, the application to
- cold start relevant data of a diesel engine can also be pertinent. The latter includes especially the extent of the rpm increase as a function of engine temperature and/or a shift in injection start in the direction of earlier injection time points.

In the following, embodiments of the invention will described with respect to the drawings.

BRIEF DESCRIPTION OF THE DRAWINGS

The invention will now be described with reference to the drawings wherein.

DESCRIPTION OF THE PREFERRED EMBODIMENT OF THE INVENTION

Figure 1:
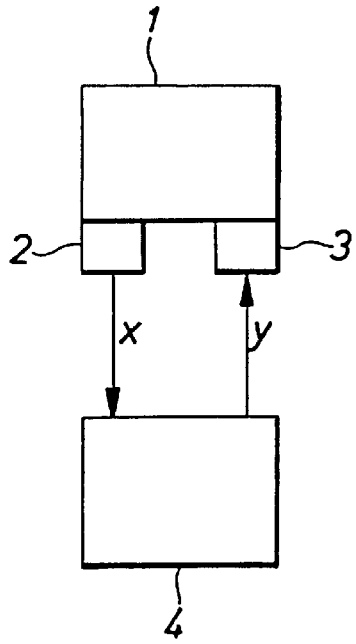
FIG. 1 shows the technical background of the invention.

Reference numeral 1 in FIG. 1 represents an internal combustion engine in a motor vehicle having a plurality of sensors 2 and a plurality of actuators 3. The sensors 2 supply input signals x to a control apparatus 4 which forms output signals y therefrom for driving the actuators 3. The plurality of sensors includes, for example, means for determining the intake air quantity, the throttle flap position, the rpm, the driving speed, the distance traveled and the like. Accordingly, the variable x represents the variety of the signals supplied by these sensors. In a like manner, the variable y represents the variety of actuating quantities such as the outputted injection pulsewidths for driving injection valves, the outputted ignition signals as well as the outputted control commands for an electronically-controlled power actuator element such as a throttle flap.

Figure 2A:
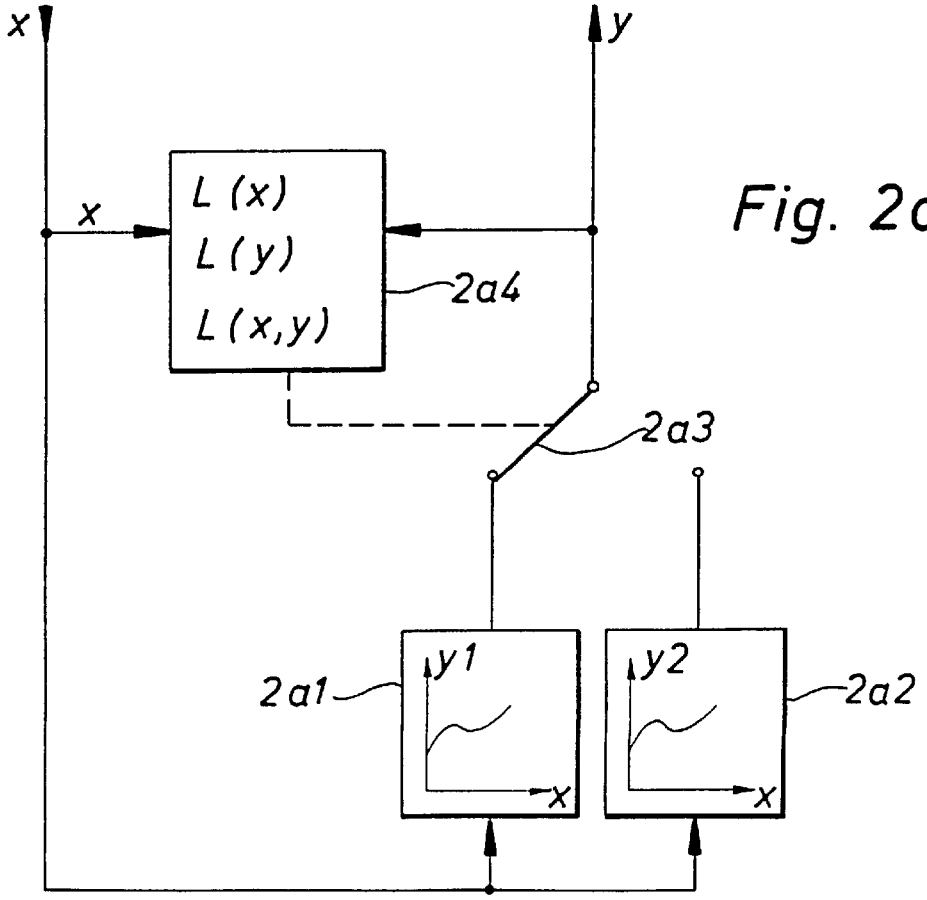
FIG. 2 shows various embodiments of the invention in a function block diagram.

FIG. 2*a* shows a first embodiment of the invention as a function block diagram of the control apparatus 4 of the invention. The blocks 2*a*1 and 2*a*2 define means for making available output quantities y as a function of input quantities x. These blocks can be realized as characteristic line memory or characteristic field memory or as computer means which compute y in dependence upon x, if required, with access to additional data.

The blocks 2*a*1 and 2*a*2 then represent, in the widest sense, sets of data for the engine control. The data set 2*a*1 is matched to the conditions, especially the increased friction power loss of a new engine; whereas, the data set 2*a*2 is adapted to the conditions of an engine which has been run in. With the switch 2*a*3, a switchover can be made from the one set of data to the other set of data. The switch 2*a*3 is actuated by block 2*a*4 which is supplied with at least a signal from the x-group and/or a signal from the y-group. From the supplied signals, the block 2*a*4 forms an index L for the running power of the engine or for the friction loss requirement of the engine, which becomes less with increasing duration of operation, and compares this index to a predetermined threshold value. Passing through the threshold value triggers an actuation of the switch 2*a*3 which then connects the second data set 2*a*2 to the actuators.

Figure 2B:
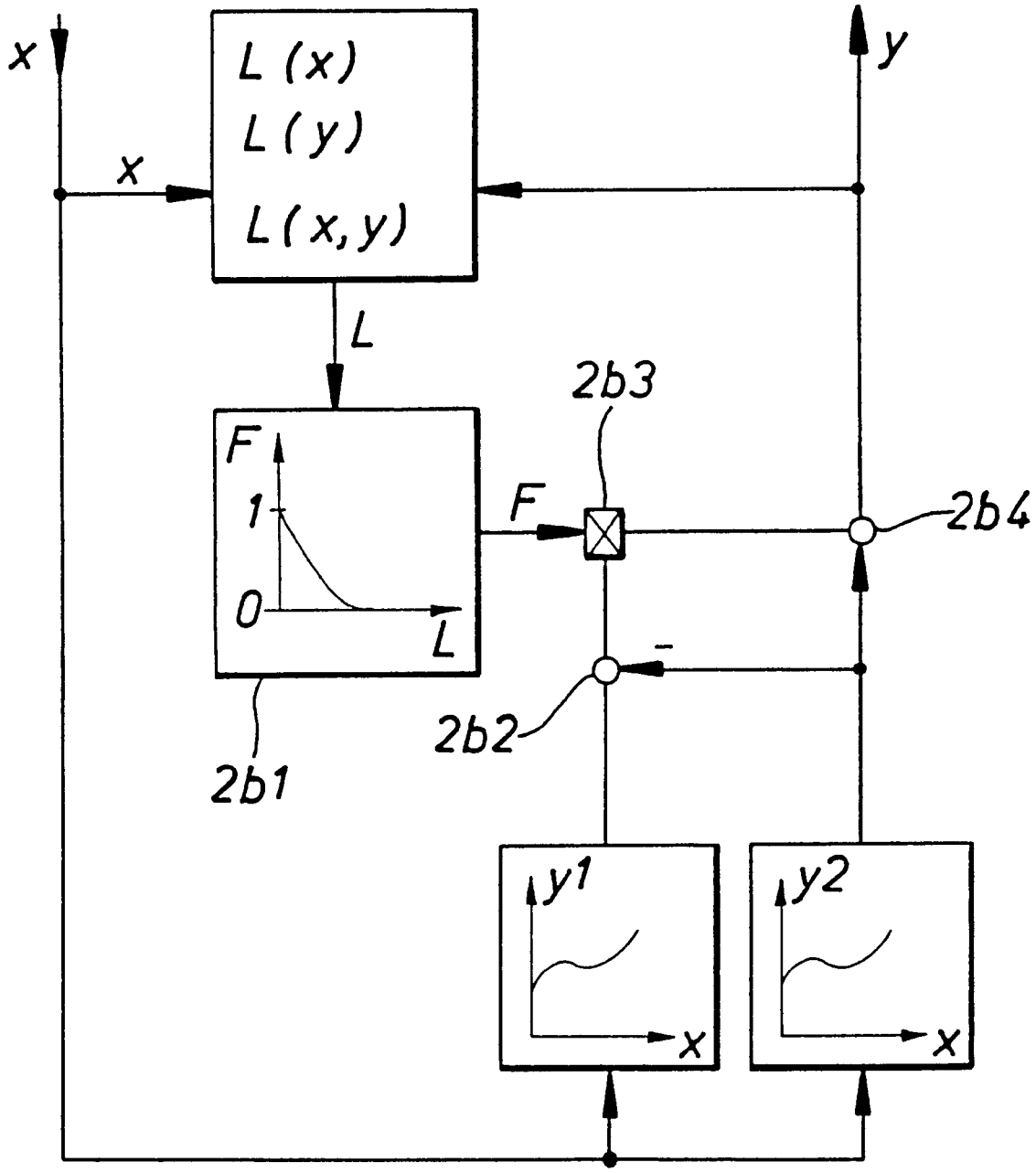

FIG. 2*b* shows a second embodiment of the invention. This embodiment is characterized by a continued transfer of the data set 2*a*1 into the data set 2*a*2. For this purpose, a weighting factor F(L) is read out from the block 2*b*1 in dependence upon the index L for the run-in state and is logically coupled multiplicatively in block 2*b*3 with the difference y1−y2 which is formed in block 2*b*2. Thereafter, the difference, which is weighted with F, is added in block 2*b*4 to the control signal y2. The eventually outputted actuating quantity y is therefore computed to y=y2+F (y1−y2). F is then a number which drops continuously from the value 1 to the value 0 with increasing L, that is, with increasing running power of the engine. That is, for a new engine, F=1 and y computes to y=y1. For a run-in engine having F=0, y computes to y2. Stated otherwise, this embodiment effects a continuous transition from the control data set y1 for the new engine to the control data set y2 for an engine which is run in.

In the following, it will be explained how the run-in state L can be easily modeled.

A counter count, which is filed in the battery-buffered RAM of the control apparatus, is incremented for each start of the engine after the elapse of a time criterion. The time criterion can, for example, be the restart counter. The restart counter is set after a start to a specific value and counted down to the value 0 in the following operation. A restart mixture enrichment is active as long as the value of the restart counter deviates from zero. The start counter is incremented when the restart counter reaches the value zero. In the initialization phase, the start counter is compared to an applicable threshold. If the value of the start counter is less than the threshold, then a conclusion is drawn as to a new engine having a high friction loss. In this case, factors from a set 1 are included in the computation for the restart mixture and the warm-running mixture. If the start counter has exceeded the threshold, then the engine already has a certain running time and therefore a reduced friction loss. Now, the mixture factor set 2 has to be computed.

Compared to conventional programs, a consideration of the friction loss of the engine and therefore the run time is possible by an evaluation of a start counter or via another modeling of the run-in state. The evaluation of the start counter is especially of little complexity and models the run-in state very well because the start operations contribute substantially to running in. Now, the run-in engine can be correspondingly supplied with fuel in accordance to its requirement and the design must no longer be orientated to the new engine having a high friction loss as a worst case. For this reason, the exhaust-gas emissions and the fuel consumption during the restart and warm-running phase can be reduced.

What is claimed is:

1. An arrangement for controlling an internal combustion engine, the arrangement comprising:

drive means for acting on said engine to influence at least one control parameter relevant for the fuel consumption of the engine;

control means for generating drive signals (y) and said control means being connected to said drive means and including means for forming an index (L) defining a run-in state of the engine; and, said control means including means for changing the drive signals (y) applied to the drive means in dependence upon said index (L) in a predetermined manner.

2. An arrangement for controlling an internal combustion engine, the arrangement comprising:

drive means for acting on said engine to influence at least one control parameter relevant for the fuel consumption of the engine;

control means for generating drive signals (y) and said control means being connected to said drive means and including means for forming an index (L) defining a run-in state of the engine;

said control means including means for changing the drive signals (y) applied to the drive means in dependence upon said index (L) in a predetermined manner;

said control means having means for keeping at least first and second sets (y1, y2) of drive signals ready wherein the first set (y1) serves for controlling the new engine and the second set (y2) serves for controlling the run-in engine; means for comparing said index (L) to a predetermined threshold value; and, said control means functioning to switch over from one of said sets of drive signals (y1, y2) to the other one of said sets of drive signals when the index (L) passes said predetermined threshold value.

3. An arrangement for controlling an internal combustion engine, the arrangement comprising:

drive means for acting on said engine to influence at least one control parameter relevant for the fuel consumption of the engine;

control means for generating drive signals (y) and said control means being connected to said drive means and including means for forming an index (L) defining a run-in state of the engine;

said control means including means for changing the drive signals (y) applied to the drive means in dependence upon said index (L) in a predetermined manner;

said control means having means for keeping at least first and second sets (y1, y2) of drive signals ready wherein the first set (y1) serves for controlling the new engine and the second set (y2) serves for controlling the run-in engine; and, said first set (y1) for the new engine is continuously transferred into said second set (y2) for the run-in engine.

4. An arrangement for controlling an internal combustion engine, the arrangement comprising:

drive means for acting on said engine to influence at least one control parameter relevant for the fuel consumption of the engine;

control means for generating drive signals (y) and said control means being connected to said drive means and including means for forming an index (L) defining a run-in state of the engine;

said control means including means for changing the drive signals (y) applied to the drive means in dependence upon said index (L) in a predetermined manner; and, means for processing at least one of the following quantities for forming said index (L):

(a) the sum of the ignitions since an original start, that is, since the first start of the engine after the manufacture thereof;

(b) the sum of the operating times which have elapsed since the original start;

(c) the distance traversed since the original start;

(d) the sum of the injection times since the original start;

(e) the integral of the through-putted air mass over the operating time since the original start;

(f) the integral of the throttle flap position since the original start;

(g) the integral of the driving speed since the original start; or, (h) the sum of the start operations in the engine which have taken place since the original start.

5. An arrangement for controlling an internal combustion engine, the arrangement comprising:

drive means for acting on said engine to influence at least one control parameter relevant for the fuel consumption of the engine;

control means for generating drive signals (y) and said control means being connected to said drive means and including means for forming an index (L) defining a run-in state of the engine;

said control means including means for changing the drive signals (y) applied to the drive means in dependence upon said index (L) in a predetermined manner; and, wherein the following are used as sets of data:

(a) base values for the fuel injection quantity;

(b) factors for the transition compensation;

(c) mixture enrichment factors for the restart phase and/or warm-running phase;

(d) mixture intervention and/or ignition intervention for load-changing measures (which cause a jolt in the drive train) or, (e) cold start relevant data of a diesel engine.

6. A method for controlling an internal combustion engine having drive means for influencing at least one control parameter relevant for the fuel consumption of the engine, and having means for forming an index (L) defining a run-in state of the engine, the method comprising the steps of:

providing control means for generating drive signals (y) and for changing the drive signals (y) applied to said drive means; and, changing said drive signals (y) in dependence upon the above-mentioned index (L) in a predetermined manner.

7. A method for controlling an internal combustion engine having drive means for influencing at least one control parameter relevant for the fuel consumption of the engine, and having means for forming an index (L) defining a run-in state of the engine, the method comprising the steps of:

providing control means for generating drive signals (y) and for changing the drive signals (y) applied to said drive means;

changing said drive signals (y) in dependence upon the above-mentioned index (L) in a predetermined manner;

utilizing said control means to hold ready at least two sets (y1, y2) of drive signals wherein the set (y1) serves to control the new engine and the set (y2) serves to control the run-in engine;

comparing the index (L) to a predetermined threshold value; and, switching over from one set of drive signals to the other set of drive signals when the index (L) passes the predetermined threshold value.

8. A method for controlling an internal combustion engine having drive means for influencing at least one control parameter relevant for the fuel consumption of the engine, and having means for forming an index (L) defining a run-in state of the engine, the method comprising the steps of:

providing control means for generating drive signals (y) and for changing the drive signals (y) applied to said drive means;

changing said drive signals (y) in dependence upon the above-mentioned index (L) in a predetermined manner; and, continuously transferring the control data set (y1) for the new engine into the control data set (y2) for the run-in engine.

9. A method for controlling an internal combustion engine having drive means for influencing at least one control parameter relevant for the fuel consumption of the engine, and having means for forming an index (L) defining a run-in state of the engine, the method comprising the steps of:

providing control means for generating drive signals (y) and for changing the drive signals (y) applied to said drive means;

changing said drive signals (y) in dependence upon the above-mentioned index (L) in a predetermined manner; and, wherein at least one of the following quantities is processed for forming the index (L):

(f) the sum of the ignitions since an original start, that is, since the first start of the engine after the manufacture thereof;

(g) the sum of the operating times which have elapsed since the original start;

(h) the travel distance traversed since the original start;

(i) the sum of the injection times since the original start;

(j) the integral of the through-putted air mass over the operating time since the original start;

(k) the integral of the throttle flap position since the original start;

(l) the integral of the driving speed since the original start; or, (m) the sum of the start operations in the engine which have taken place since the original start.

10. A method for controlling an internal combustion engine having drive means for influencing at least one control parameter relevant for the fuel consumption of the engine, and having means for forming an index (L) defining a run-in state of the engine, the method comprising the steps of:

providing control means for generating drive signals (y) and for changing the drive signals (y) applied to said drive means;

changing said drive signals (y) in dependence upon the above-mentioned index (L) in a predetermined manner; and, wherein the following are used as sets of data:

(a) base values for the fuel injection quantity;

(b) factors for the transition compensation;

(c) mixture enrichment factors for the restart phase and/or warm-running phase;

(d) mixture intervention and/or ignition intervention for load-changing measures (which cause a jolt in the drive train) or, (e) cold start relevant data of a diesel engine.

* * * * *